US007692391B2

(12) United States Patent
Nakada et al.

(10) Patent No.: US 7,692,391 B2
(45) Date of Patent: Apr. 6, 2010

(54) DISCHARGE LAMP BALLAST, LIGHTING SYSTEM AND PROJECTOR

(75) Inventors: Katsuyoshi Nakada, Katano (JP); Hirofumi Konishi, Hirakata (JP); Junichi Hasegawa, Neyagawa (JP); Koji Watanabe, Kadoma (JP); Kiyoaki Uchihashi, Kobe (JP); Toshiaki Sasaki, Hirakata (JP)

(73) Assignee: Panasonic Electric Works Co., Ltd., Kadoma-shi (JP)

( * ) Notice: Subject to any disclaimer, the term of this patent is extended or adjusted under 35 U.S.C. 154(b) by 642 days.

(21) Appl. No.: 10/585,632

(22) PCT Filed: Aug. 31, 2004

(86) PCT No.: PCT/JP2004/012518

§ 371 (c)(1),
(2), (4) Date: Jul. 11, 2006

(87) PCT Pub. No.: WO2005/072020

PCT Pub. Date: Aug. 4, 2005

(65) Prior Publication Data

US 2008/0218094 A1 Sep. 11, 2008

(51) Int. Cl.
*H05B 41/36* (2006.01)

(52) U.S. Cl. ..... 315/291; 315/209 R; 315/326

(58) Field of Classification Search ..... 315/291, 315/177, 209 R, 326, DIG. 7, DIG. 5
See application file for complete search history.

(56) References Cited

U.S. PATENT DOCUMENTS 5,932,976 A 8/1999 Maheshwari et al.
5,962,981 A * 10/1999 Okude et al. ..... 315/128
6,194,845 B1 2/2001 Konopka et al.
6,437,515 B1 8/2002 Kamoi et al.
6,965,204 B2 * 11/2005 Langeslag ..... 315/209 R
7,154,228 B2 * 12/2006 Van Casteren et al. ... 315/209 R
2002/0047609 A1 4/2002 Weng
2003/0151377 A1 * 8/2003 Slegers ..... 315/291

(Continued)

FOREIGN PATENT DOCUMENTS

JP 10-144488 5/1998

(Continued)

OTHER PUBLICATIONS

European Search Report, Oct. 28, 2008, issued in EP 04 77 2474.

*Primary Examiner*—Douglas W Owens
*Assistant Examiner*—Jianzi Chen
(74) *Attorney, Agent, or Firm*—Edwards Angell Palmer & Dodge LLP

(57) ABSTRACT

A discharge lamp ballast having a starting circuit including a second inductor connected between a first end of a discharge lamp and the positive voltage side of a first capacitor; a second capacitor forming a resonance circuit together with the second inductor; a second switching element connected between the positive terminal of a DC power source and the second end of the lamp; a third switching element connected between the second end of the lamp and the negative voltage side of the first capacitor; and a starting controller that controls both switching elements. The starting controller alternately turns both switching elements on and off so as to contribute resonance voltage of the resonance circuit for starting of the lamp in case of the starting mode.

12 Claims, 20 Drawing Sheets

U.S. PATENT DOCUMENTS

2003/0160577 A1 * 8/2003 Noguchi et al. ..... 315/291
2003/0214253 A1 11/2003 Okamoto et al.

FOREIGN PATENT DOCUMENTS

JP 2003-243196 8/2003
JP 2003-257689 9/2003
JP 2003-332093 11/2003
WO WO03039206 A1 * 5/2003

* cited by examiner

DISCHARGE LAMP BALLAST, LIGHTING SYSTEM AND PROJECTOR

BACKGROUND OF THE INVENTION

1 Field of the Invention

The invention relates to discharge lamp ballasts, lighting systems and projectors that apply starting voltage across discharge lamps at a starting mode and supply the lamps with DC power for steady operating (lighting) at a steady operating mode after the starting mode.

2 Description of the Related Art

A discharge lamp ballast for a DC discharge lamp comprises a voltage step down converter in order to supply the lamp with DC power for a steady operating state at a steady operating mode. Also, in case that the lamp is a high pressure discharge lamp (HID lamp) such as a metal halide lamp or the like, the ballast is provided with an igniter that generates high voltage pulse from several kV to 10 s kV with a pulse transformer (see, e.g., Japanese Patent Publication number H10-144488).

However, when the above transformer provides the lamp with high voltage from several kV to 10 s kV, electromagnetic induction noise (flux) is radiated from the transformer and therefore there is a problem that the noise gives the ballast and peripheral circuits erroneous operation.

SUMMARY OF THE INVENTION

It is therefore an object of the present invention to reduce noise from a starting means that applies starting voltage across a discharge lamp.

A discharge lamp ballast of the present invention comprises: a voltage step down converter connected to a DC power source with a positive terminal and a negative terminal; a converter control means that controls the converter; a first capacitor that applies DC voltage across a discharge lamp having a first end and a second end through DC power from the converter; and a starting means that applies starting voltage across the lamp in case of a starting mode. The converter is constructed with a diode, a first switching element and a first inductor. The diode has a cathode and an anode, and the anode is connected to the negative terminal of the DC power source and a negative voltage side of the first capacitor. The first switching element is connected between the cathode of the diode and the positive terminal of the DC power source. The first inductor is connected between the cathode of the diode and a positive voltage side of the first capacitor. In case of a steady operating mode after the starting mode, the converter control means turns the first switching element on and off at a high frequency so as to supply DC power for steady operating to the lamp via the first capacitor. For an aspect of the present invention, the starting means comprises a second inductor, a second capacitor, a second switching element, a third switching element and a starting control means. The second inductor is connected between the first end of the lamp and the positive voltage side of the first capacitor. The second capacitor is connected in parallel with the lamp and forms a resonance circuit together with the second inductor. The second switching element is connected between the positive terminal of the DC power source and the second end of the lamp. The third switching element is connected between the second end of the lamp and the negative voltage side of the first capacitor. The starting control means controls the second switching element and the third switching element. In case of the steady operating mode, the starting control means operates so as to include an on period of the third switching element while keeping the second switching element turned off. In case of the starting mode, the starting control means alternately turns the second switching element and the third switching element on and off so as to contribute resonance voltage of the resonance circuit for starting of the lamp. Thus, by contributing the resonance voltage for starting of the lamp, noise from the starting means can be reduced.

The present invention may comprise a transformer with a primary winding and a secondary winding, and utilize the primary winding as the second inductor. In this case, the secondary winding is connected in series with the lamp, while the series combination of the secondary winding and the lamp is connected in parallel with the secondary capacitor. Thus, induction voltage responding to a resonance current passing through the primary winding is superposed onto resonance voltage across the second capacitor, so that the starting voltage applied across the lamp is increased.

The second capacitor of the present invention may have capacitance smaller than that of the first capacitor. Thus, the second capacitor has capacitance smaller than that of the first capacitor and therefore the resonance current is reduced, while the first capacitor has capacitance larger than that of the second capacitor and therefore ripple voltage across the first capacitor for the lamp is reduced.

In case of the steady operating mode, the starting control means of the present invention may turn the third switching element on and off while synchronizing the turning on and off of the third switching element with the turning on and off of the first switching element.

In case of the starting mode, the starting control means of the present invention may alternately turn the second switching element and the third switching element on and off approximately at a resonance frequency of the resonance circuit.

In case of the starting mode, the starting control means of the present invention may alternately turn the second switching element and the third switching element on and off approximately at a frequency f0×1/ODD, where f0 is a resonance frequency of the resonance circuit and ODD is an odd number. In this invention, because an odd harmonic frequency of square wave voltage applied across the LC resonance circuit becomes approximately equal to the resonance frequency of the resonance circuit, the lamp can be started with the resonance voltage of the resonance circuit.

In case of the starting mode, the starting control means of the present invention may alternately turn the second switching element and the third switching element on and off at a switching frequency of a continuous sweep frequency or a switching frequency of multistage frequency. It is also preferable that the starting control means sweeps the switching frequency from a first frequency to a second frequency, while the means repeats the sweeping operation. It is further preferable that the first frequency is higher than the second frequency.

In case of a grow-arc transition mode between the starting mode and the steady operating mode, the starting control means of the present invention may alternately turn the second switching element and the third switching element on and off at a switching frequency lower than that in the starting mode. In this invention, the lamp is able to preferably transit from grow discharge to arc discharge after breakdown.

Therefore, the present invention achieves reduction of noise from the starting means and gives benefit of the noise reduction and high reliability in equipment such as a lighting system constructed with the ballast and the lamp, a projector constructed with the ballast and the lamp, or the like.

BRIEF DESCRIPTION OF THE DRAWINGS

Exemplary embodiments of the invention will now be described in further details. Other features and advantages of the present invention will become better understood with regard to the following detailed description and accompanying drawings where:

FIG. 21(*b*) illustrates another example of arrangement of a pulse transformer in the ballast of FIG. 20; and FIG. 21(*c*) illustrates another example of arrangement of a pulse transformer in the ballast of FIG. 20.

DETAILED DESCRIPTION OF THE EXEMPLARY EMBODIMENTS

Figure 1:
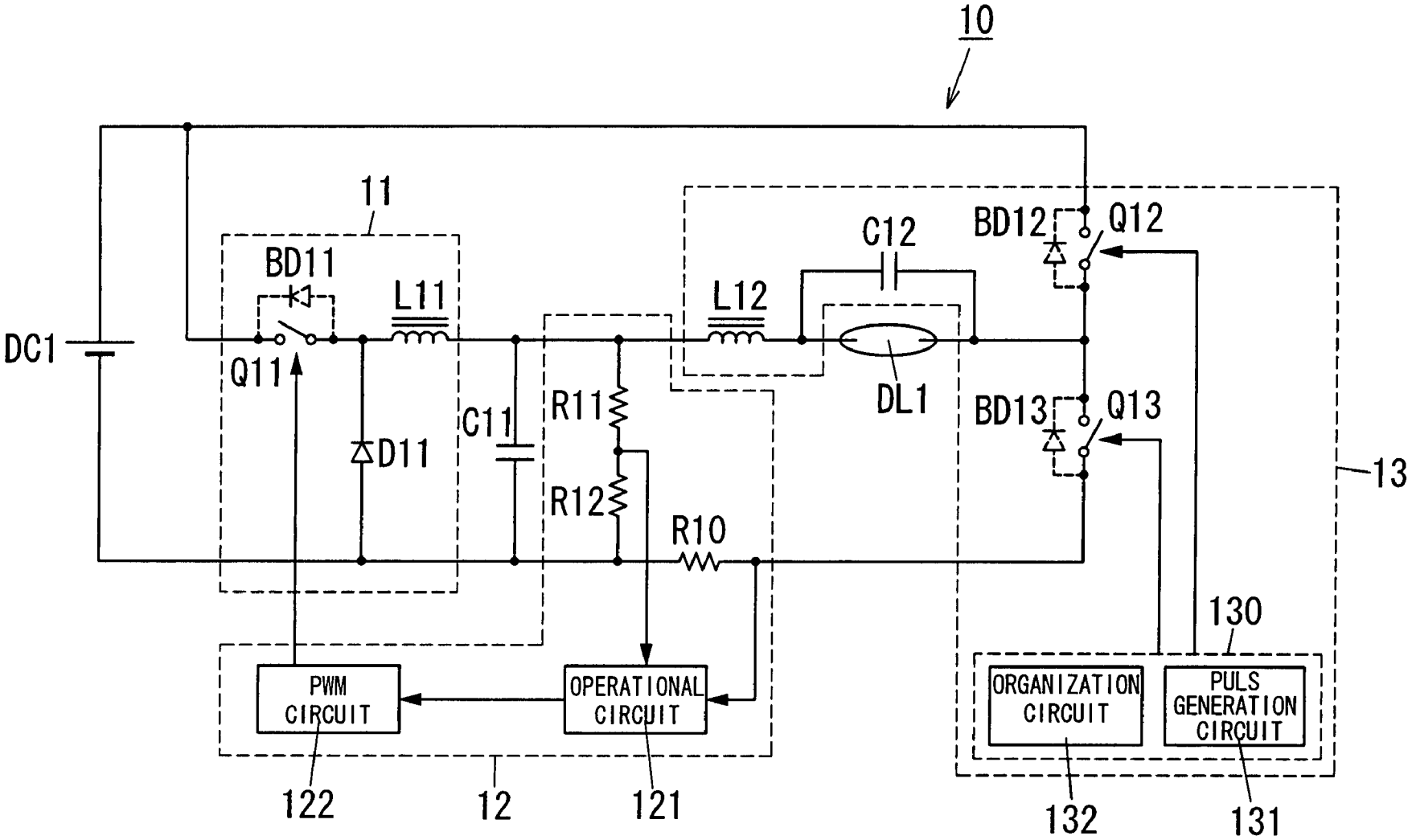
FIG. 1 is a circuit diagram of a discharge lamp ballast according to a first embodiment of the present invention.

FIG. 1 illustrates a discharge lamp ballast 10 for a discharge lamp DL1 (e.g., a DC discharge lamp such as a HID lamp or the like). This ballast 10 comprises a voltage step down converter 11 connected to a DC power source DC1 with a positive terminal and a negative terminal, and a capacitor C11 that applies DC voltage across the lamp DL1 having a first end and a second end through DC power from the converter 11, and also comprises a converter controller (converter control means) 12 and a starter (starting means) 13.

The voltage step down converter 11 is constructed with a diode D11, a switching element Q11 and an inductor L11. The diode D11 has a cathode and an anode, and the anode is connected to the negative terminal of the source DC1 and a negative voltage side of the capacitor C11.

The switching element Q11 is connected between the cathode of the diode D11 and the positive terminal of the source DC1. The element Q11 is, for example, a power MOSFET with a diode (body diode) BD 11, and its drain and source are connected to the positive terminal of the source DC1 and the cathode of the diode D11, respectively. A cathode and an anode of the diode BD11 are also connected to the drain and the source of the power MOSFET, respectively. The inductor L11 is connected between the cathode of the diode D11 and a positive voltage side of the capacitor C11.

The converter controller 12 is constructed with a low-resistance resistor R10 (current detection means), series resistors R11 and R12 (voltage detection means), an operational circuit 121 and a PWM (pulse width modulation) circuit 122, and controls the converter 11.

The resistor R10 is located between the negative voltage side of the capacitor C11 and a switching element Q13 of the starter 13, and detects a lamp current. The resistors R11 and R12 are connected in parallel with the capacitor C11, and detects lamp voltage (voltage across the capacitor C11).

In case of a steady operating mode after a starting mode, the operational circuit 121 figures out lamp power based on the lamp current detected through the resistor R10 and the lamp voltage detected through the resistors R11 and R12, and then calculates difference (voltage) between target power and the lamp power. The PWM circuit 122 controls pulse widths of a control signal to (a gate of) the switching element Q11 so that the difference calculated through the circuit 121 becomes zero.

In short, the converter controller 12 turns the switching element Q11 on and off at a high frequency so as to supply DC power (target power) for steady operating to the lamp DL1 via the capacitor C11 in case of the steady operating mode.

The starter 13 is constructed with an inductor L12, a capacitor C12 having capacitance smaller than that of the capacitor C11, switching elements Q12 and Q13, and a starting controller (starting control means) 130 that controls the elements Q12 and Q13, and applies starting voltage across the lamp DL1 in case of the starting mode.

The inductor L12 is connected between the first end of the lamp DL1 and the positive voltage side of the capacitor C11. The capacitor C12 is connected in parallel with the lamp DL1 and forms a resonance circuit together with the inductor L12. The inductor L12 and the capacitor C12 also constitutes a low pass filter. For example, a value of the inductor L12 may be 600 μH and a value of the capacitor C12 may be 3,300 pF.

The switching element Q12 is, for example, a power MOSFET with a diode (body diode) BD 12, and its drain and source are connected to the positive terminal of the source DC1 and the second end of the lamp DL1, respectively. The switching element Q13 is, for example, a power MOSFET with a diode (body diode) BD 13, and its drain and source are connected to the second end of the lamp DL1 and the negative voltage side of the capacitor C11, respectively. A cathode and an anode of each body diode are the drain and the source of the power MOSFET, respectively.

The starting controller 130 is constructed with a pulse generation circuit 131 and an organization circuit 132. In case of the starting mode, the pulse generation circuit 131 alternately turns the switching elements Q12 and Q13 on and off so that the lamp DL1 is started by resonance voltage of the above resonance circuit. In case of the starting mode, the circuit 131 in the first embodiment alternately turns the switching elements Q12 and Q13 on and off approximately at a resonance frequency (e.g., 115 KHz) of the resonance circuit in order to secure the starting voltage of the lamp DL1 through the resonance voltage.

In case of the steady operating mode, the organization circuit 132 operates so as to include an on period of the switching element Q13 while keeping the switching element Q12 turned off. In the first embodiment, the circuit 132 turns the switching element Q13 on and then holds the turn on, while keeping the switching element Q12 turned off in case of the steady operating mode.

Figure 2:
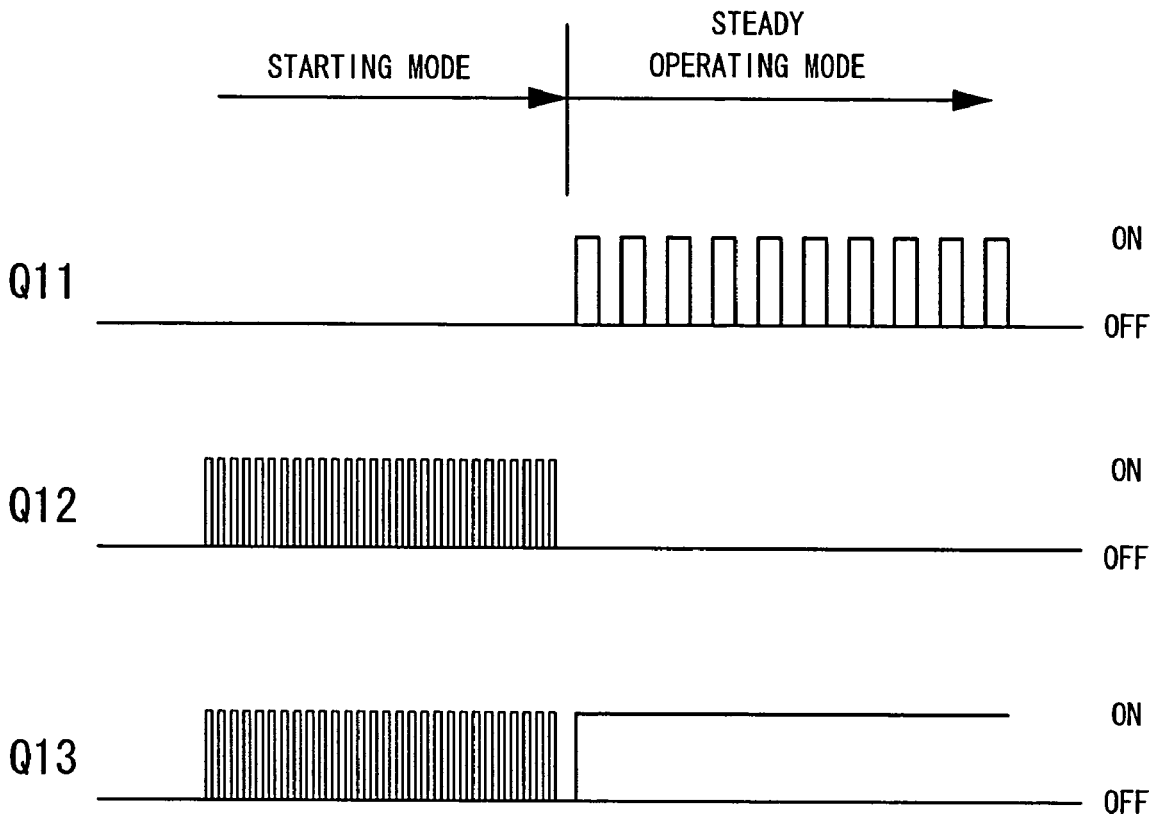
FIG. 2 illustrates control signals to switching elements of the ballast of FIG. 1.

The operation of the discharge lamp ballast 10 is now explained with reference to FIG. 2. In a starting mode, the switching elements Q12 and Q13 are alternately turned on and off approximately at the resonance frequency of the resonance circuit. When the switching element Q12 is turned on, the DC power source DC1 applies square wave voltage mainly across the capacitor C12, the inductor L12 and the capacitor C11. In this case, by fundamental frequency (i.e., switching frequency of Q12, Q13) component of the square wave voltage, a resonance current mainly passes through a closed circuit constructed of the source DC1, the switching element Q12, the capacitor C12, the inductor L12 and the capacitor C11, or a closed circuit constructed of the inductor L12, the capacitor C11, the resistor R10, the switching element Q13 (BD13) and the capacitor C12. When the resonance current reverses its direction, the current mainly passes through a closed circuit constructed of the capacitor C12, the switching element Q13, the resistor R10, the capacitor C11 and the inductor L12. By the resonance operation, resonance voltage across the capacitor C12 is applied across the lamp DL1, and thereby the lamp DL1 is started. After the starting of the lamp DL1, the operation mode is sifted to a steady operating mode.

In the steady operating mode, the switching element Q12 is held off and also the switching element Q13 is turned and held on, while the switching element Q11 is turned on and off at a high frequency so as to supply DC power for steady operating to the lamp DL1 via the capacitor C11. By holding the switching elements Q12 and Q13 off and on, respectively, the circuit of the ballast 10 is organized into a circuit for DC operating (lighting).

When the switching element Q11 is turned on, a charging current flows from the source DC1 to the capacitor C11 via the switching element Q11 and the inductor L11, and thereby the capacitor C11 is charged. When the switching element Q11 is turned off, a regenerative current by energy accumulated in the inductor L11 flows from the inductor L11 to the capacitor C11 via diode D11. On time of the switching element Q11 is controlled with pulse widths of a control signal from the PWM circuit 122, and thereby DC power for steady operating is supplied to the lamp DL1.

According to the first embodiment of the present invention, starting of the lamp DL1 is possible through the resonance voltage of the resonance circuit with no use of a pulse transformer, and therefore it is possible to reduce noise from the starter 13 that applies the starting voltage across the lamp DL1. Also, because the starting voltage is AC, electrode wear of the lamp DL1 is reduced. Moreover, the capacitor C12 has a capacitance smaller than that of the capacitor C11 and therefore the resonance current can be reduced, while the capacitor C11 has capacitance larger than that of the capacitor C12 and therefore ripple voltage across the capacitor C11 for the lamp DL1 (DC discharge lamp) can be reduced.

In an alternate embodiment, the pulse generation circuit 131 alternately turns the switching elements Q12 and Q13 on and off approximately at a frequency (switching frequency) f0×1/ODD in case of the starting mode, where f0 is a resonance frequency of the above resonance circuit and ODD is an odd number (e.g., 3). In this embodiment, because an odd harmonic frequency of square wave voltage applied across the LC resonance circuit becomes approximately equal to the resonance frequency of the resonance circuit, it is possible to secure the starting voltage of the lamp DL1 through the resonance voltage of the resonance circuit as well as the first embodiment. For example, when a value of the inductor L12 is 100 μH and a value of the capacitor C12 is 2,200 pF, the switching frequency is 115 KHz. According to this embodiment, it is possible to make the resonance circuit compact. The switching frequency can be also reduced (e.g., ⅓,⅕,⅐,. . . ).

Figure 3:
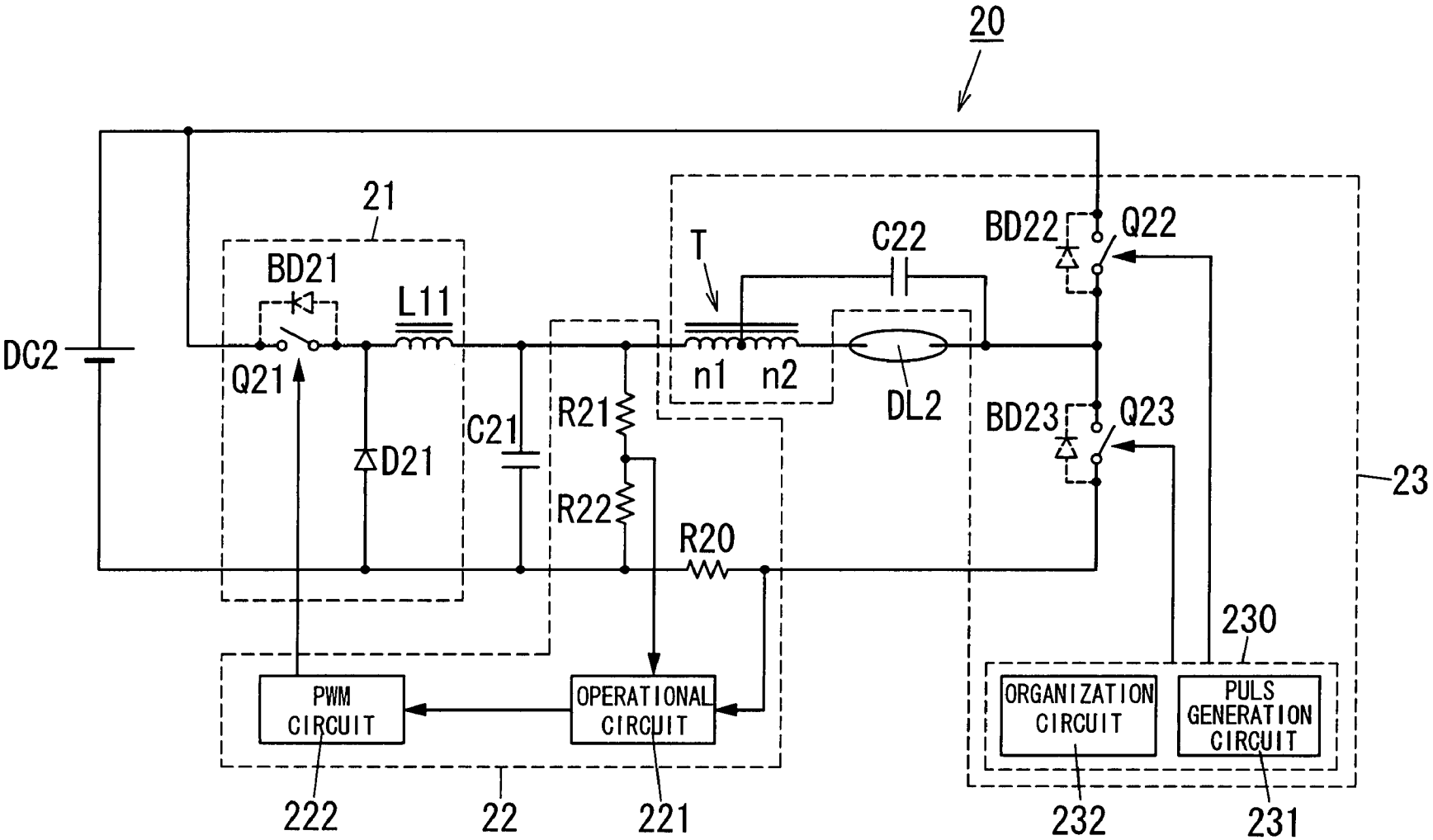
FIG. 3 is a circuit diagram of a discharge lamp ballast according to a second embodiment of the present invention.

FIG. 3 illustrates a discharge lamp ballast 20 for a discharge lamp DL2 (e.g., a DC discharge lamp such as a HID lamp or the like). This ballast 20 is characterized by a transformer T having a primary winding nil and a secondary winding n2 in a starter 23 as compared with the first embodiment that is different only in that the inductor L12 is provided with the starter 13.

In this second embodiment, the inductor L12 of FIG. 1 is replaced by the primary winding n1. The secondary winding n2 is utilized to superpose induction voltage responding to a resonance current passing through the primary winding n1 onto resonance voltage across a capacitor C22. The winding n2 is connected in series with the lamp DL2, while the series combination of the winding n2 and the lamp DL2 is connected in parallel with the capacitor C22. In FIG. 3, the winding n2 is also directly connected in series with the winding n1. The level of the induction voltage can be adjusted with a turn ratio (n1:n2) of the transformer T.

According to the second embodiment of the present invention, since the induction voltage responding to the resonance current passing through the primary winding n1 is superposed onto the resonance voltage across the capacitor C22, staring voltage applied across the lamp DL2 can be increased.

Figure 4:
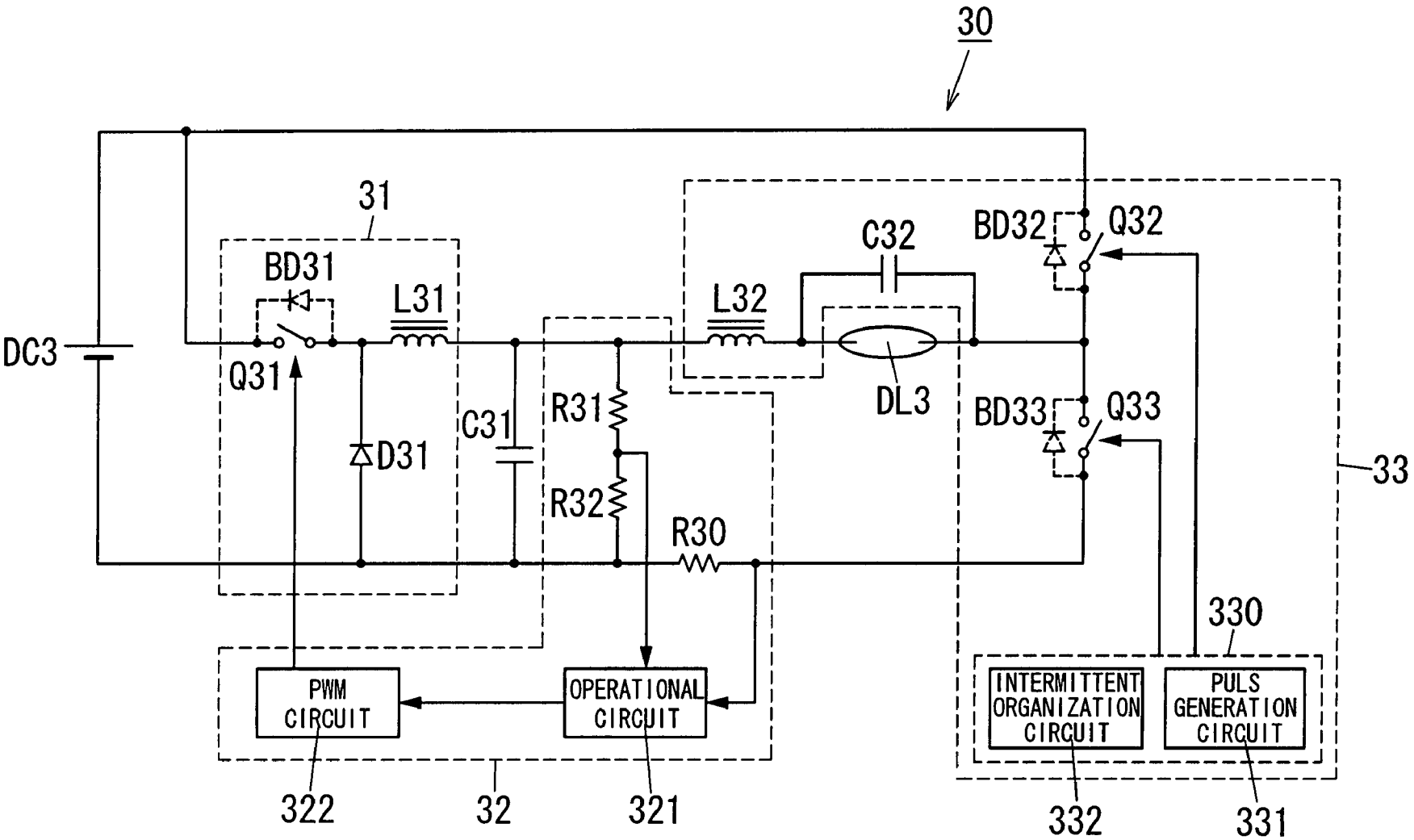
FIG. 4 is a circuit diagram of a discharge lamp ballast according to a third embodiment of the present invention.

FIG. 4 illustrates a discharge lamp ballast 30 for a discharge lamp DL3 (e.g., a DC discharge lamp such as a HID lamp or the like). This ballast 30 is characterized by an intermittent organization circuit 332 provided in a starting controller 330 of a starter 33 as compared with the first embodiment that is different only in that the organization circuit 132 is provided in the starting controller 130 of the starter 13.

Figure 5:
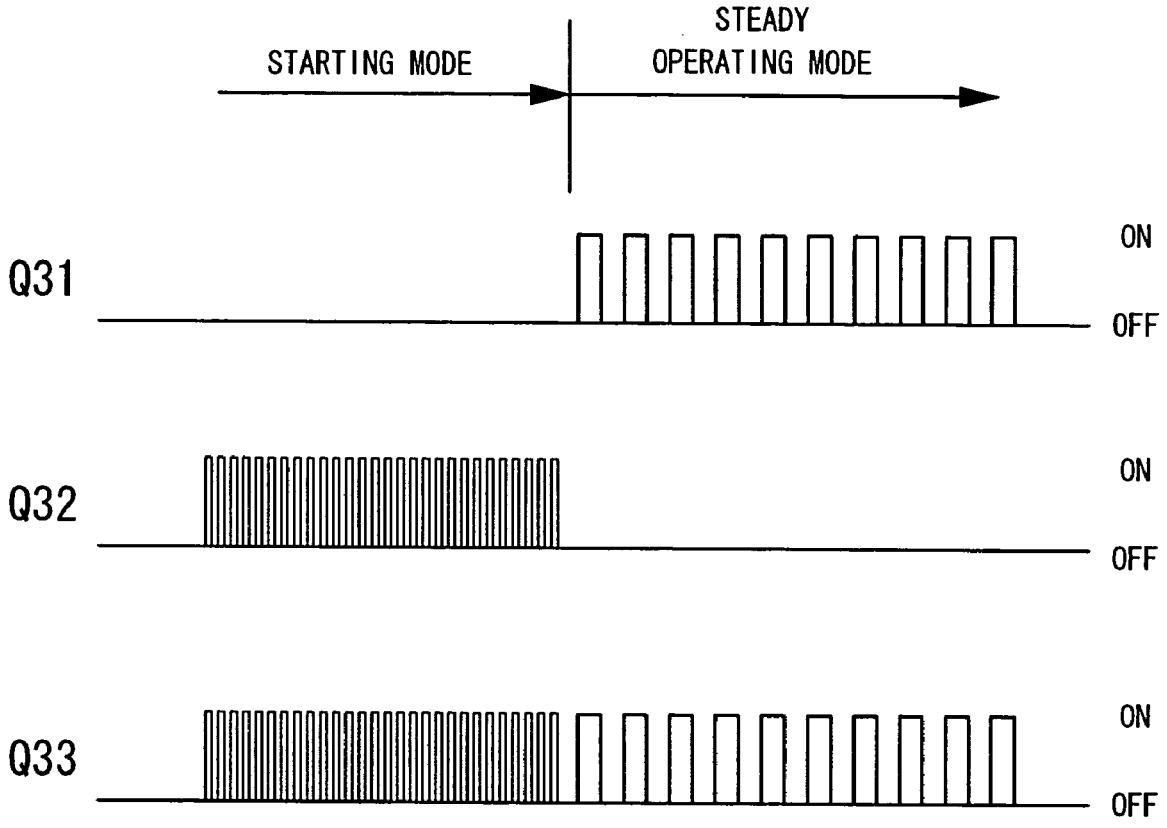
FIG. 5 illustrates control signals to switching elements of the ballast of FIG. 4.

In the steady operating mode (FIG. 5), the intermittent organization circuit 332 in this third embodiment holds the switching element Q32 off and also turns the switching element Q33 on and off, while the circuit 332 synchronizes the turning on and off of the switching element Q33 with the turning on and off of the switching element Q31.

According to the third embodiment of the present invention, it is possible to reduce noise from the starter 33 that applies starting voltage across the lamp DL3 as well as the first embodiment. The intermittent organization circuit 332 of the third embodiment is also applicable to the starting controller 230 in the second embodiment.

Figure 6:
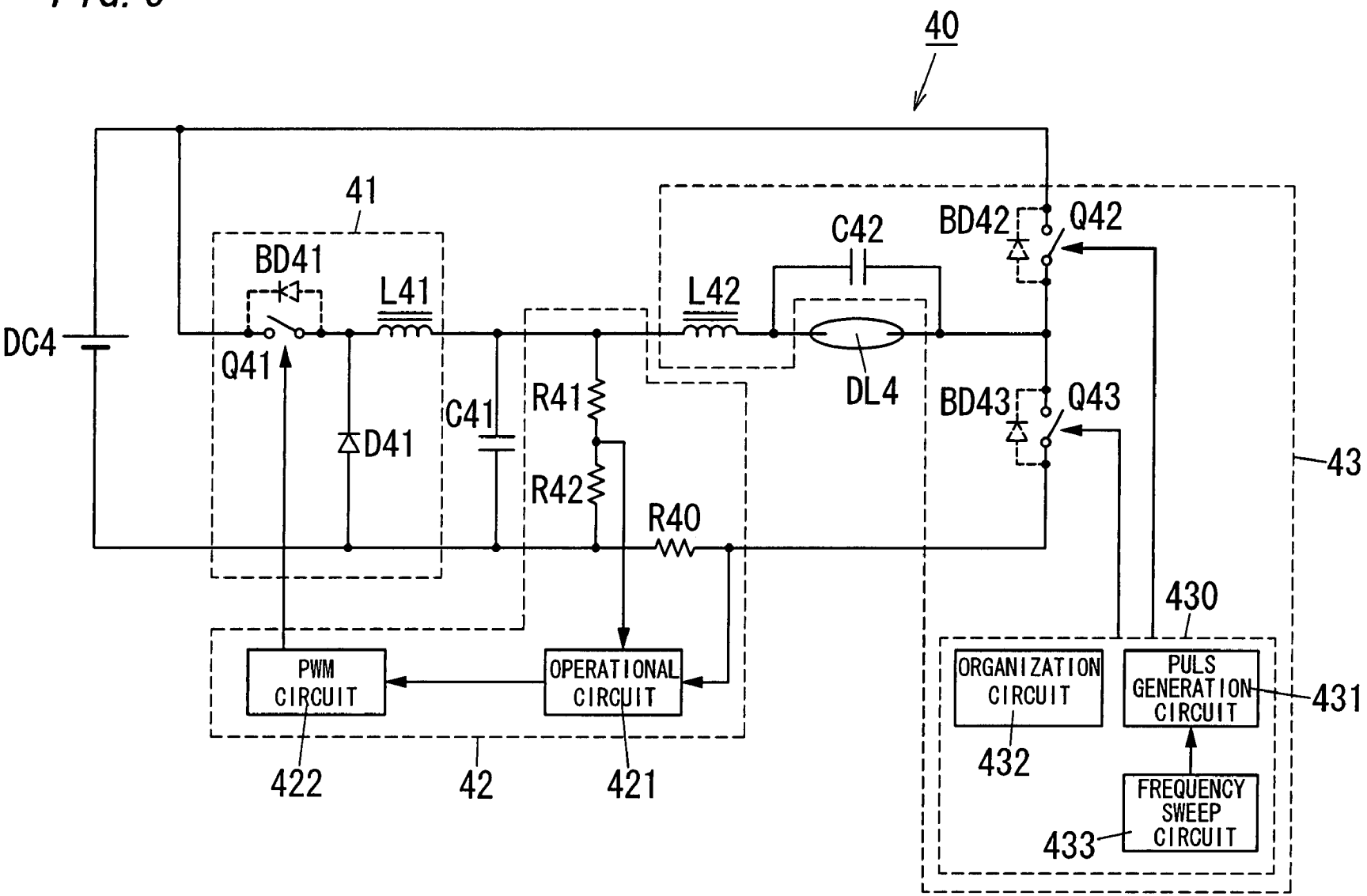
FIG. 6 is a circuit diagram of a discharge lamp ballast according to a fourth embodiment of the present invention.

FIG. 6 illustrates a discharge lamp ballast 40 for a discharge lamp DL4 (e.g., a DC discharge lamp such as a HID lamp or the like). This ballast 40 is characterized by a frequency sweep circuit 433 further provided in a starting controller 430 of a starter 43 as compared with the first embodiment that is different only in that the starting controller 130 consists of the pulse generation circuit 131 and the organization circuit 132.

Figure 7:
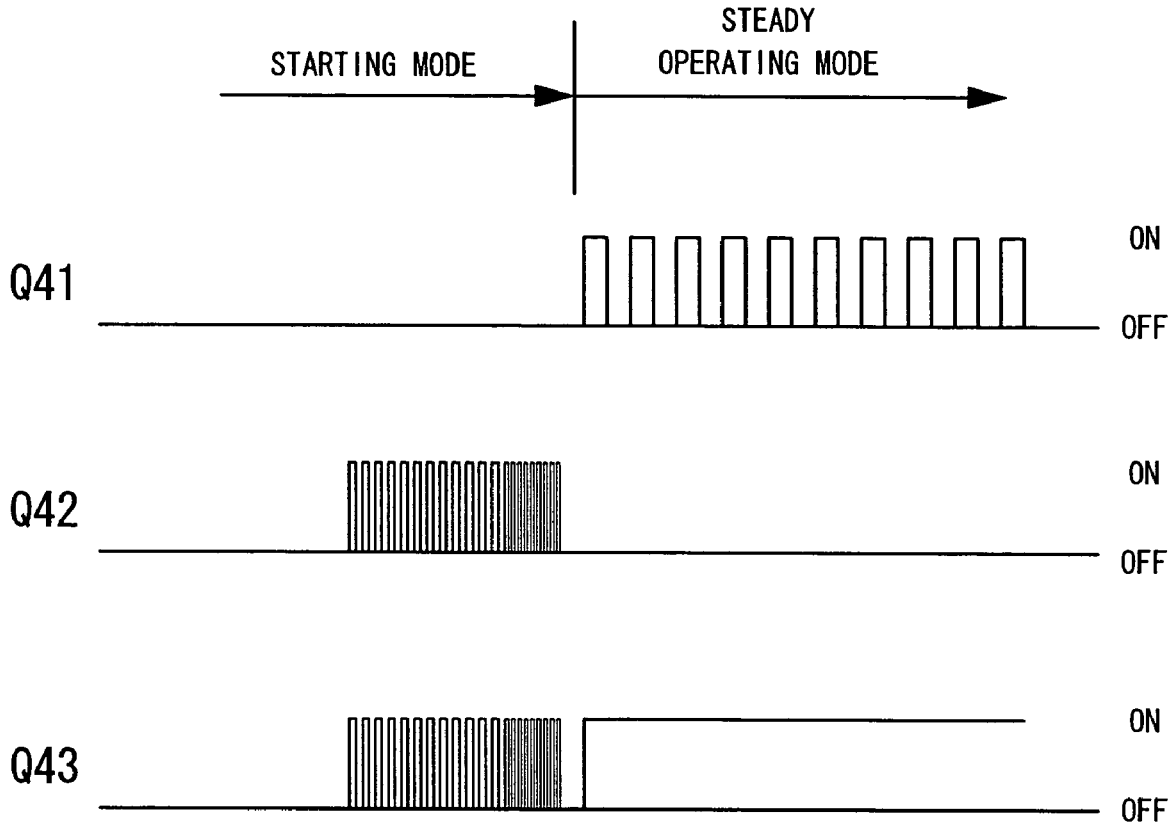
FIG. 7 illustrates control signals to switching elements of the ballast of FIG. 6.

In the starting mode (FIG. 7), the frequency sweep circuit 433 in this fourth embodiment alternately turns the switching elements Q42 and Q43 on and off at a switching frequency of a continuous sweep frequency through a pulse generation circuit 431. The range of the continuous sweep frequency includes a resonance frequency of a resonance circuit constructed with an inductor L42 and a capacitor C42, and is set to, for example, 50 KHz-160 KHZ when the resonance frequency is 115 KHz.

Figure 8:
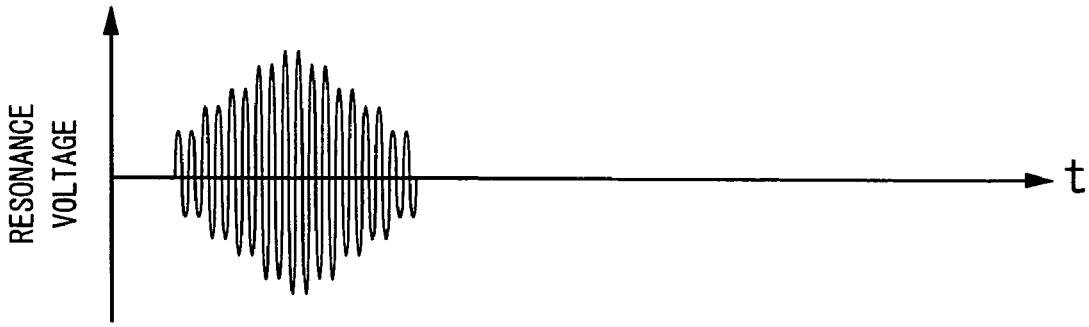
FIG. 8 illustrates waveform of resonance voltage (starting voltage) through the ballast of FIG. 6.

According to the fourth embodiment of the present invention, starting voltage is able to include the resonance voltage of the resonance circuit (FIG. 8) without influence of each unevenness of the inductor L42 and the capacitor C42. As a result, the lamp DL4 can be started with the starting voltage. The frequency sweep circuit 433 of the fourth embodiment is also applicable to the starting controller 230 in the second embodiment or the starting controller 330 in the third embodiment.

In an alternate embodiment, the above range of the continuous sweep frequency (substantially) includes a frequency f0×1/ODD, where f0 is the resonance frequency of the resonance circuit and ODD is an odd number. According to this embodiment, the starting voltage is able to include the resonance voltage of the resonance circuit, and the lamp DL4 can be started with the starting voltage as well as the fourth embodiment.

Figure 9:
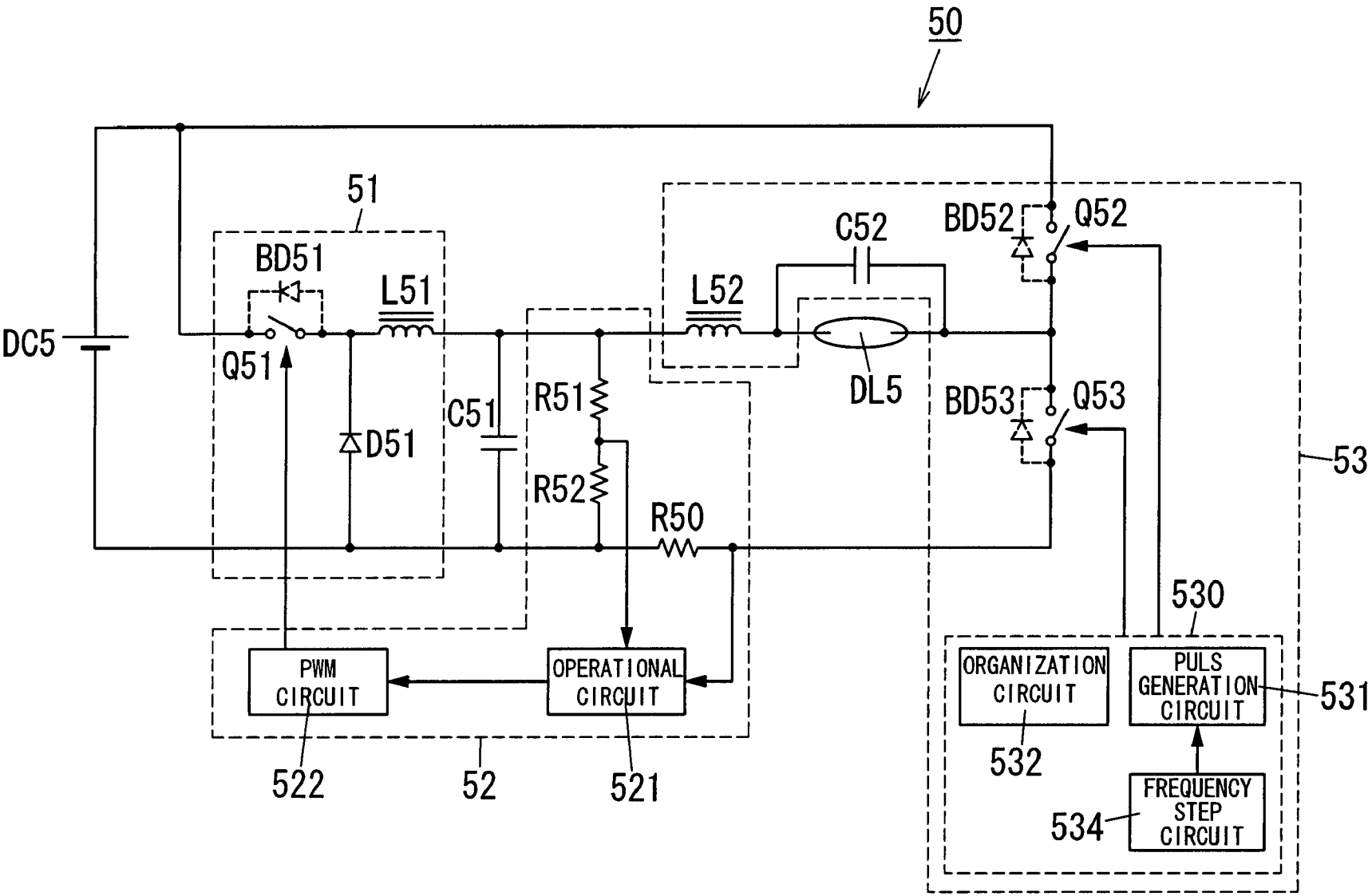
FIG. 9 is a circuit diagram of a discharge lamp ballast according to a fifth embodiment of the present invention.

FIG. 9 illustrates a discharge lamp ballast 50 for a discharge lamp DL5 (e.g., a DC discharge lamp such as a HID lamp or the like). This ballast 50 is characterized by a frequency step circuit 534 further provided in a starting controller 530 of a starter 53 as compared with the first embodiment that is different only in that the starting controller 130 consists of the pulse generation circuit 131 and the organization circuit 132.

Figure 10:
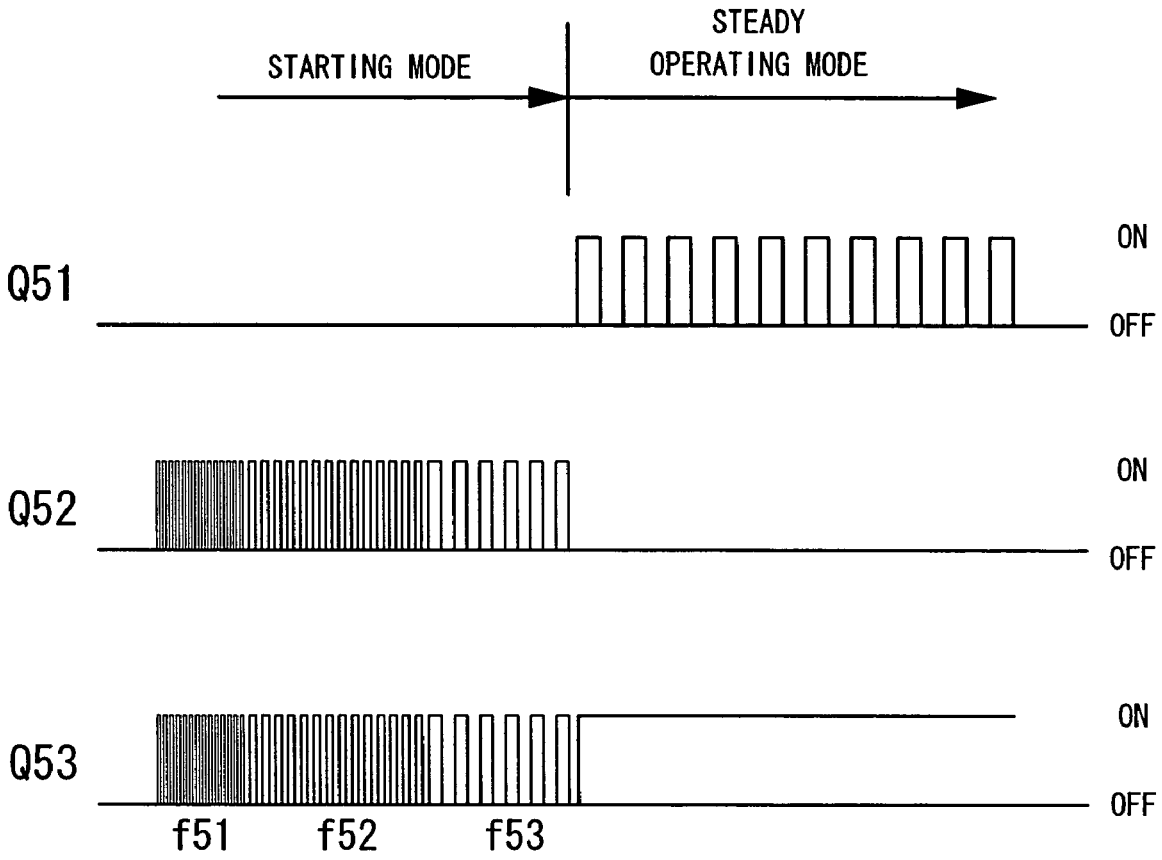
FIG. 10 illustrates control signals to switching elements of the ballast of FIG. 9.

In this fifth embodiment, the frequency step circuit 534 alternately turns switching elements Q52 and Q53 on and off at a switching frequency of a multistep frequency through a pulse generation circuit 531 in a starting mode. As shown in FIG. 10, the above switching frequency of the multistep frequency consists of, for example, stepped down frequencies f51, f52 or f53 (f51>f52>f53). In a preferred embodiment, the frequency f51 is set to approximately a resonance frequency of a resonance circuit constructed with an inductor L52 and a capacitor C52, while the frequencies f52 and f53 are set so that a lamp current of the lamp DL5 steps up after breakdown of the lamp DL5.

According to the fifth embodiment of the present invention, the lamp DL5 is able to start through the starting voltage with approximately resonance voltage of the resonance circuit, and moreover the lamp DL5 can ideally transit from grow discharge to arc discharge after breakdown. As a result, starting performance (prevention of non-lighting) of the lamp DL1 can be improved. The frequency step circuit 534 of the fifth embodiment is also applicable to the starting controller 230 in the second embodiment or the starting controller 330 in the third embodiment.

In an alternate embodiment, the above frequency f51 is approximately a frequency f0×1/ODD, where f0 is the resonance frequency of the resonance circuit and ODD is an odd number. According to this embodiment, the lamp is able to start through the starting voltage with approximately the resonance voltage of the resonance circuit as well as the fifth embodiment.

In another alternate embodiment, when the lamp DL5 is started at the frequency f52, the frequency f52 is set to approximately the resonance frequency of the resonance circuit or approximately the frequency f0×1/ODD, where f0 is the resonance frequency of the resonance circuit and ODD is an odd number.

Figure 11:
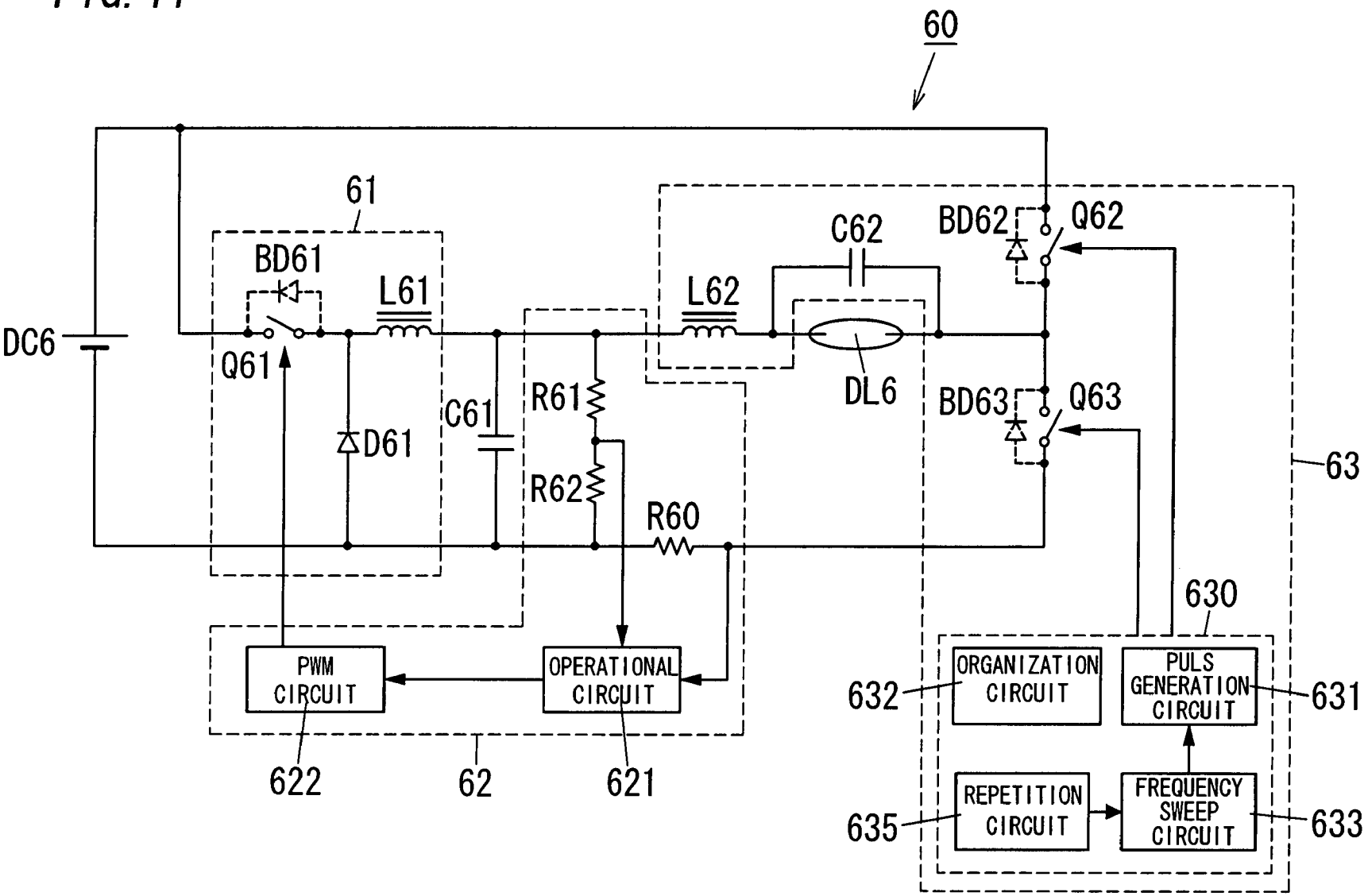
FIG. 11 is a circuit diagram of a discharge lamp ballast according to a sixth embodiment of the present invention.

FIG. 11 illustrates a discharge lamp ballast 60 for a discharge lamp DL6 (e.g., a DC discharge lamp such as a HID lamp or the like). This ballast 60 is characterized by a repetition circuit 635 further provided in a starting controller 630 of a starter 63 as compared with the fourth embodiment that is different only in that the starting controller 430 consists of the pulse generation circuit 431, the organization circuit 432 and the frequency sweep circuit 433.

Figure 12:
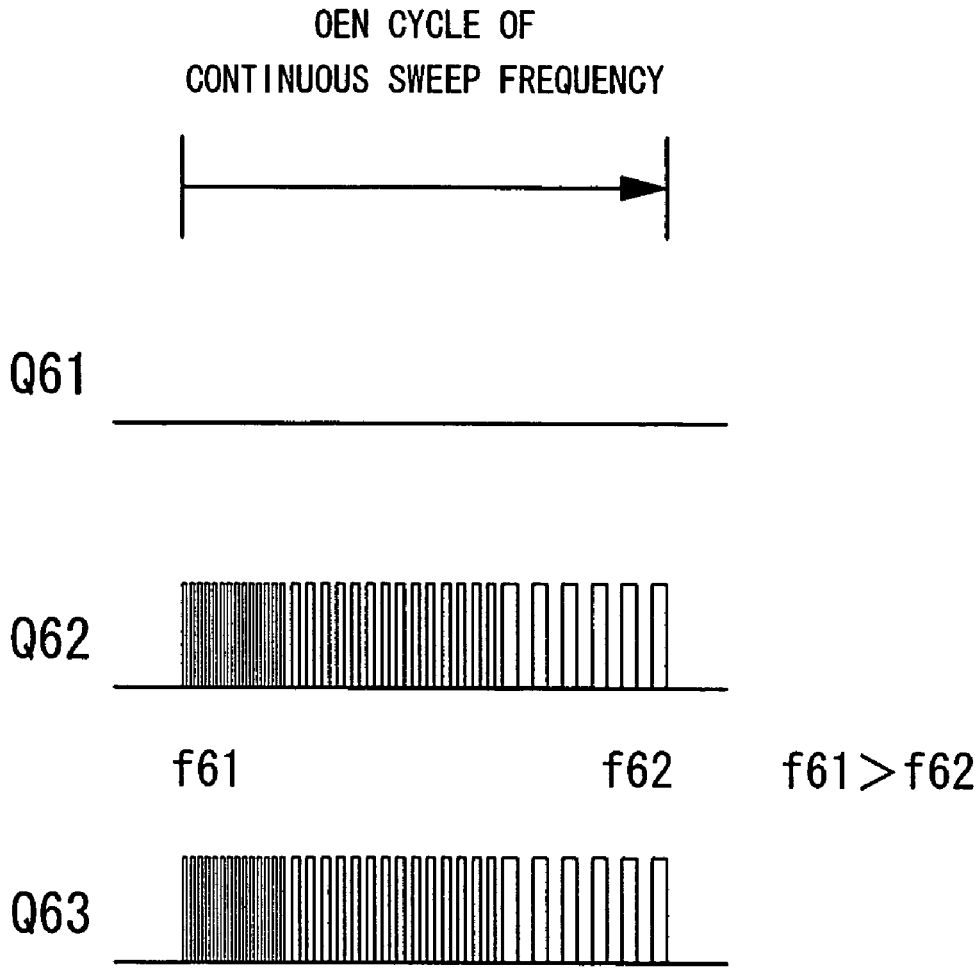
FIG. 12 illustrates control signals to switching elements of the ballast of FIG. 11.
Figure 13:
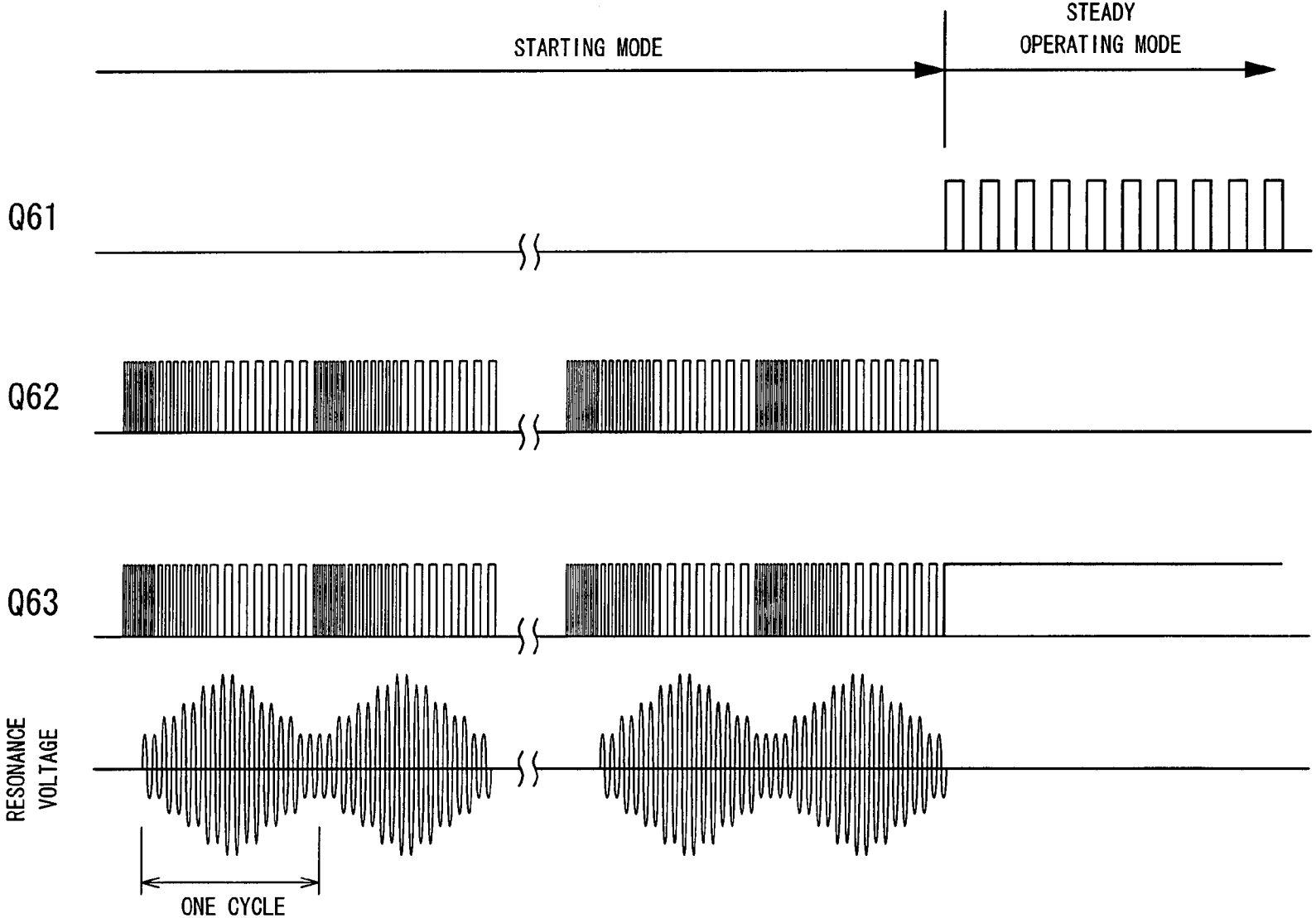
FIG. 13 illustrates the signals to switching elements of the ballast of FIG. 11 and waveform of resonance voltage (starting voltage) through the ballast.
Figure 14:
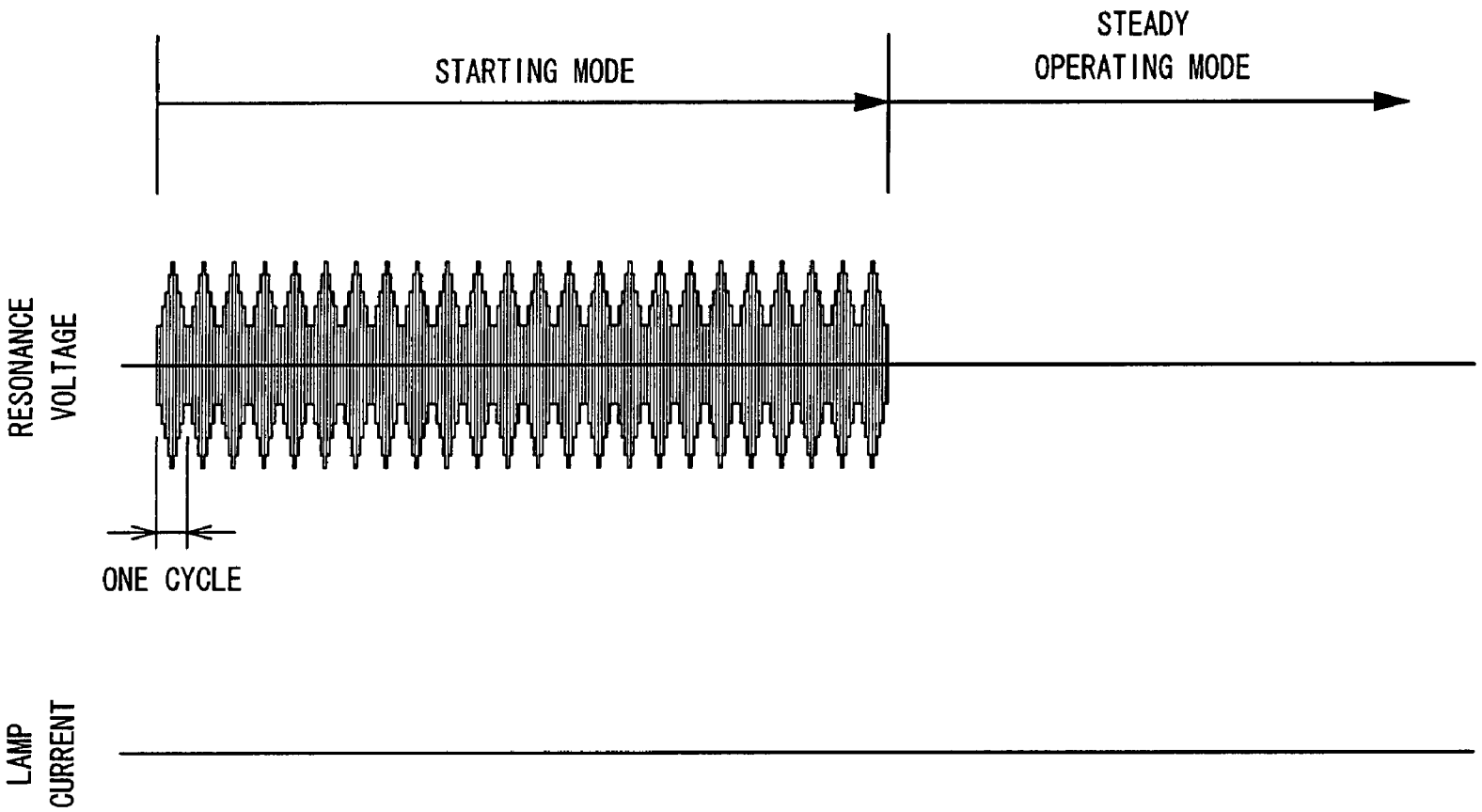
FIG. 14 illustrates resonance voltage (lamp voltage) and a lamp current in case that a discharge lamp does not reach breakdown through the ballast of FIG. 11.
Figure 15:
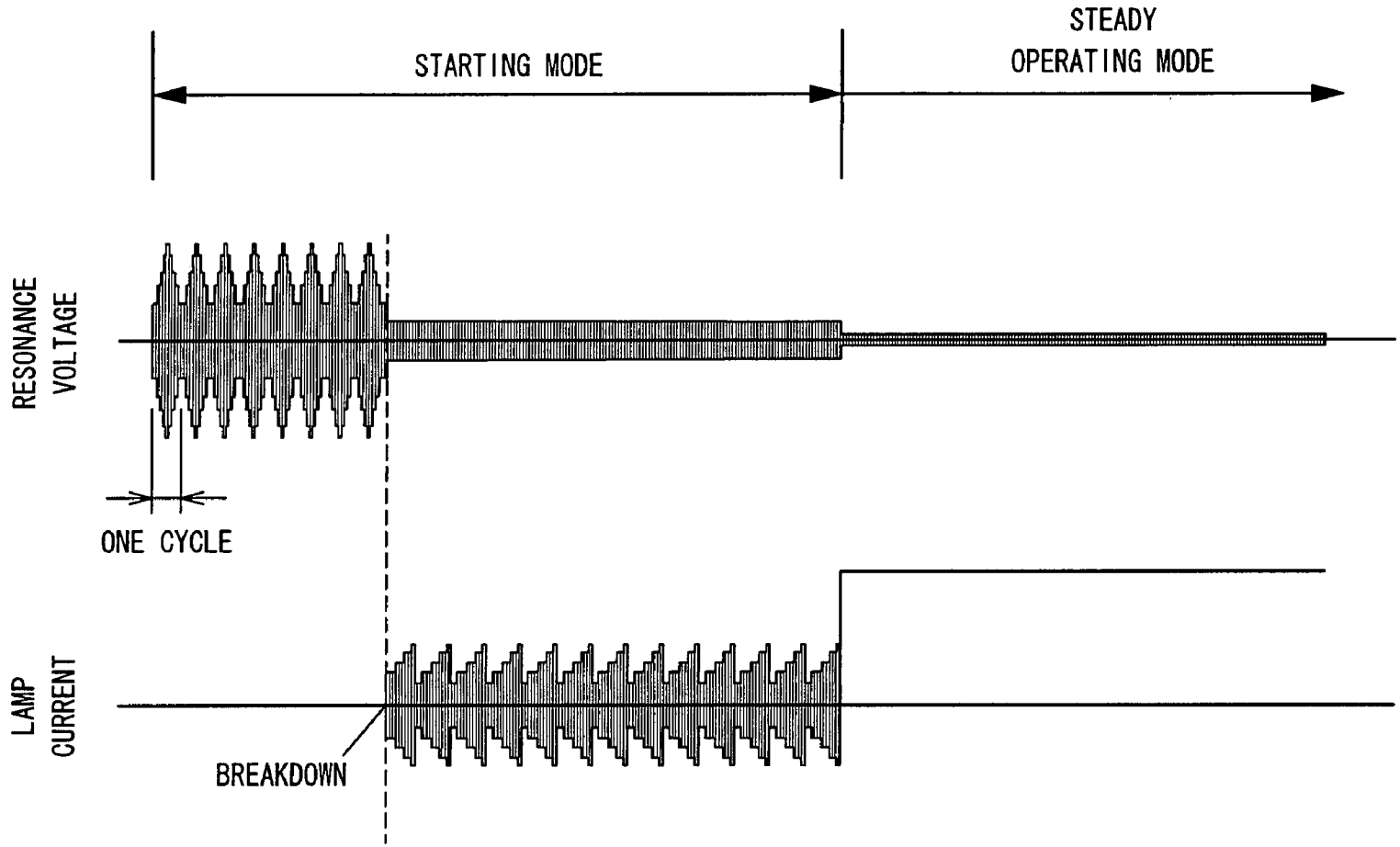
FIG. 15 illustrates resonance voltage (lamp voltage) and a lamp current in case that the lamp reaches breakdown through the ballast of FIG. 11.

In this sixth embodiment, the repetition circuit 635 repeats sweep operation of a frequency sweep circuit 633 in case of a starting mode. As shown in examples of FIGS. 12 and 13, when one cycle of the continuous sweep frequency from the frequency f61 to the frequency f62 (<f61) is about 400 μsec and a period of a starting mode is 1 sec, the sweep operation is repeated about 2,500 times. FIG. 14 illustrates resonance voltage (lamp voltage) and a lamp current in case that the lamp DL 6 does not reach breakdown, and FIG. 15 illustrates resonance voltage (lamp voltage) and a lamp current in case that the lamp DL6 reaches breakdown.

According to the sixth embodiment of the present invention, because starting voltage including the resonance voltage is repeatedly applied across the lamp DL6, more preferable starting of the lamp DL6 is possible. The repetition circuit 635 of the sixth embodiment is also applicable to the starting controller 530 in the fifth embodiment.

Figure 16:
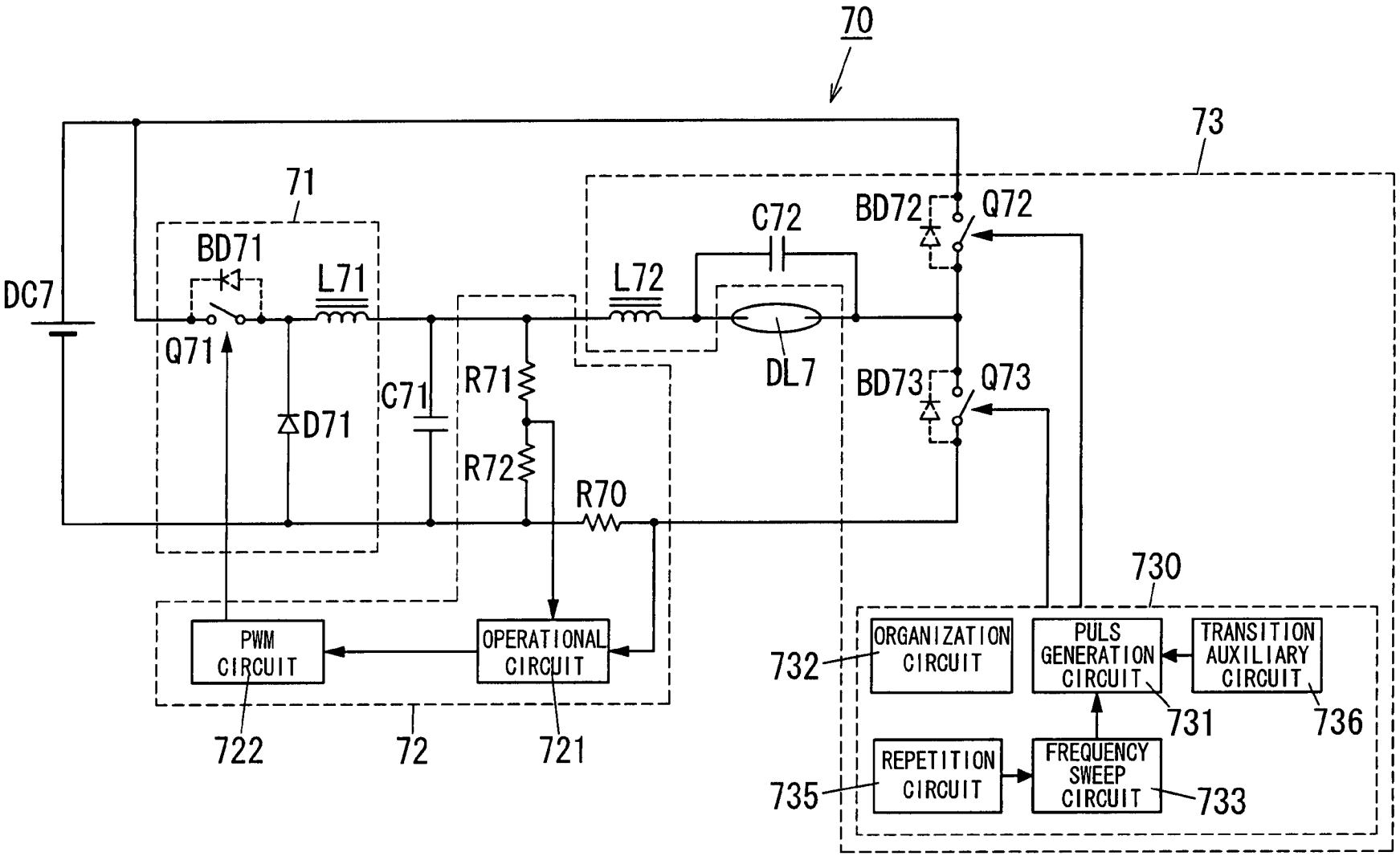
FIG. 16 is a circuit diagram of a discharge lamp ballast according to a seventh embodiment of the present invention.

FIG. 16 illustrates a discharge lamp ballast 70 for a discharge lamp DL7 (e.g., a DC discharge lamp such as a HID lamp or the like). This ballast 70 is characterized by a transition auxiliary circuit 736 further provided in a starting controller 730 of a starter 73 as compared with the sixth embodiment that is different only in that the starting controller 630 consists of the pulse generation circuit 631, the organization circuit 632, the frequency sweep circuit 633 and the repetition circuit 635.

Figure 17:
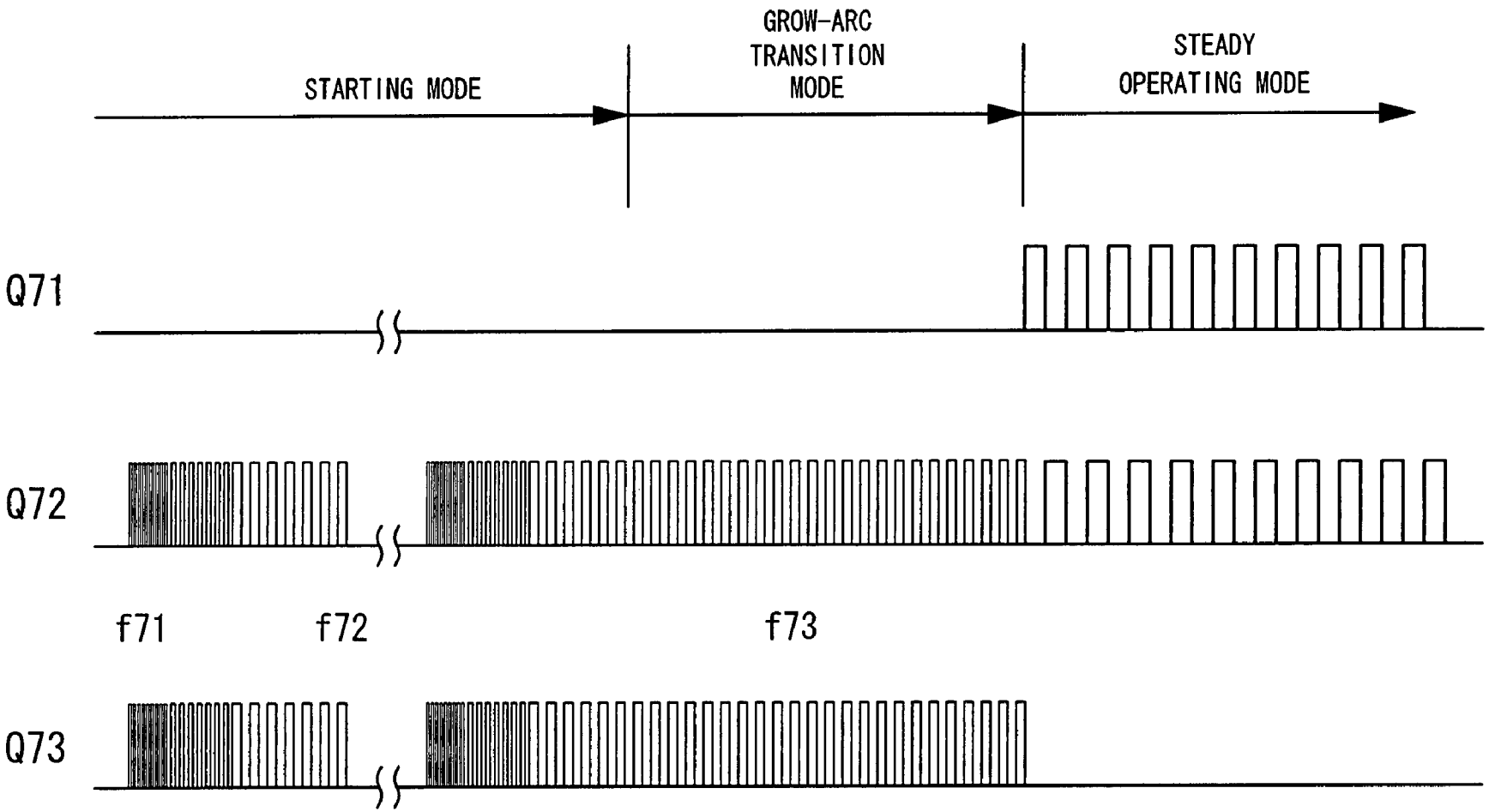
FIG. 17 illustrates control signals to switching elements of the ballast of FIG. 16.
Figure 18:
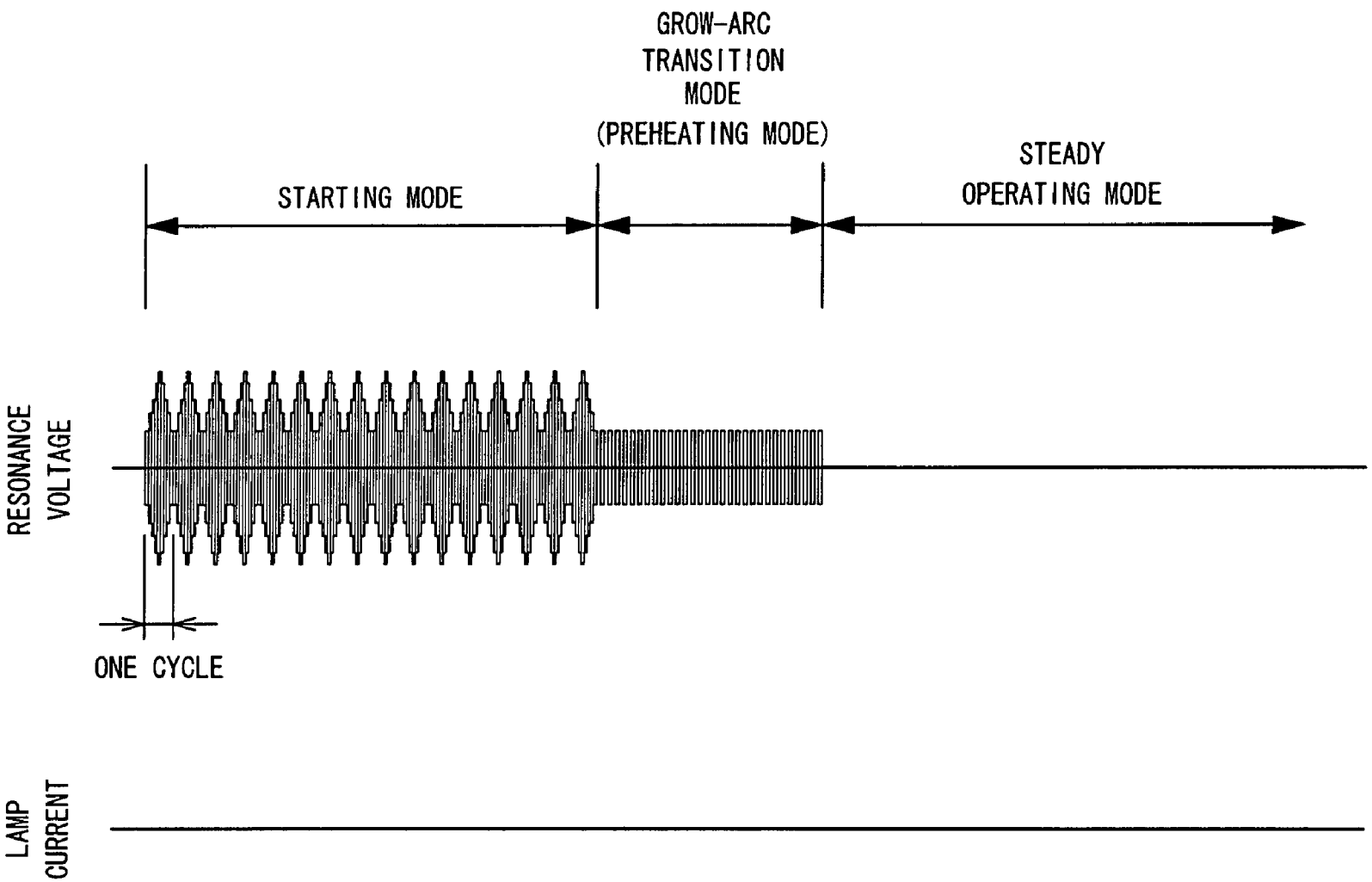
FIG. 18 illustrates resonance voltage (lamp voltage) and a lamp current in case that a discharge lamp does not reach breakdown through the ballast of FIG. 16.
Figure 19:
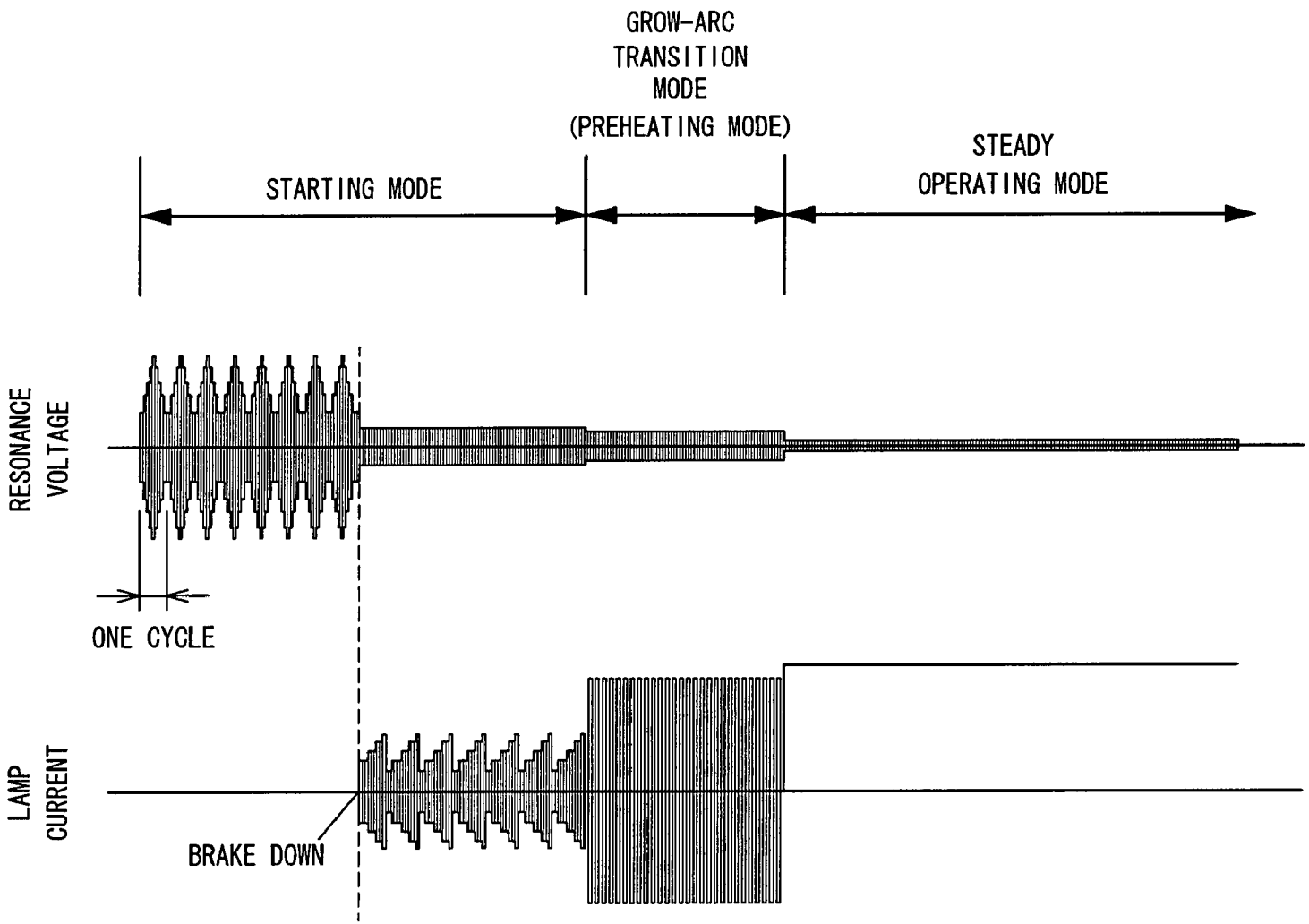
FIG. 19 illustrates resonance voltage (lamp voltage) and a lamp current in case that the lamp reaches breakdown through the ballast of FIG. 16.

In case of the grow-arc transition mode between the starting mode and the steady operating mode (FIG. 17), the transition auxiliary circuit 736 in this seventh embodiment alternately turns switching elements Q72 and Q73 on and off at a switching frequency f73 (<f72) lower than a switching frequency of f71-f72 (f71>f72) in the starting mode through a pulse generation circuit 731. A period of the grow-arc transition mode and the switching frequency f73 is set based on time taken until breakdown of the lamp DL7 and state leading to stable transition from grow to arc of the lamp DL7. For example, the switching frequency of f71-f72 is set with 115 KHz and the period of the starting mode is set for 1 second, while the switching frequency f73 is set to 52 KHz and the period of the grow-arc transition mode is set for 0.5 second. FIG. 18 illustrates resonance voltage (lamp voltage) and a lamp current in case that the lamp DL7 does not reach breakdown, and FIG. 19 illustrates resonance voltage (lamp voltage) and a lamp current in case that the lamp DL7 reaches breakdown.

According to the seventh embodiment of the present invention, it is possible to stably lead the lamp DL7 to arc discharge and to stably operate the lamp DL7.

Figure 20:
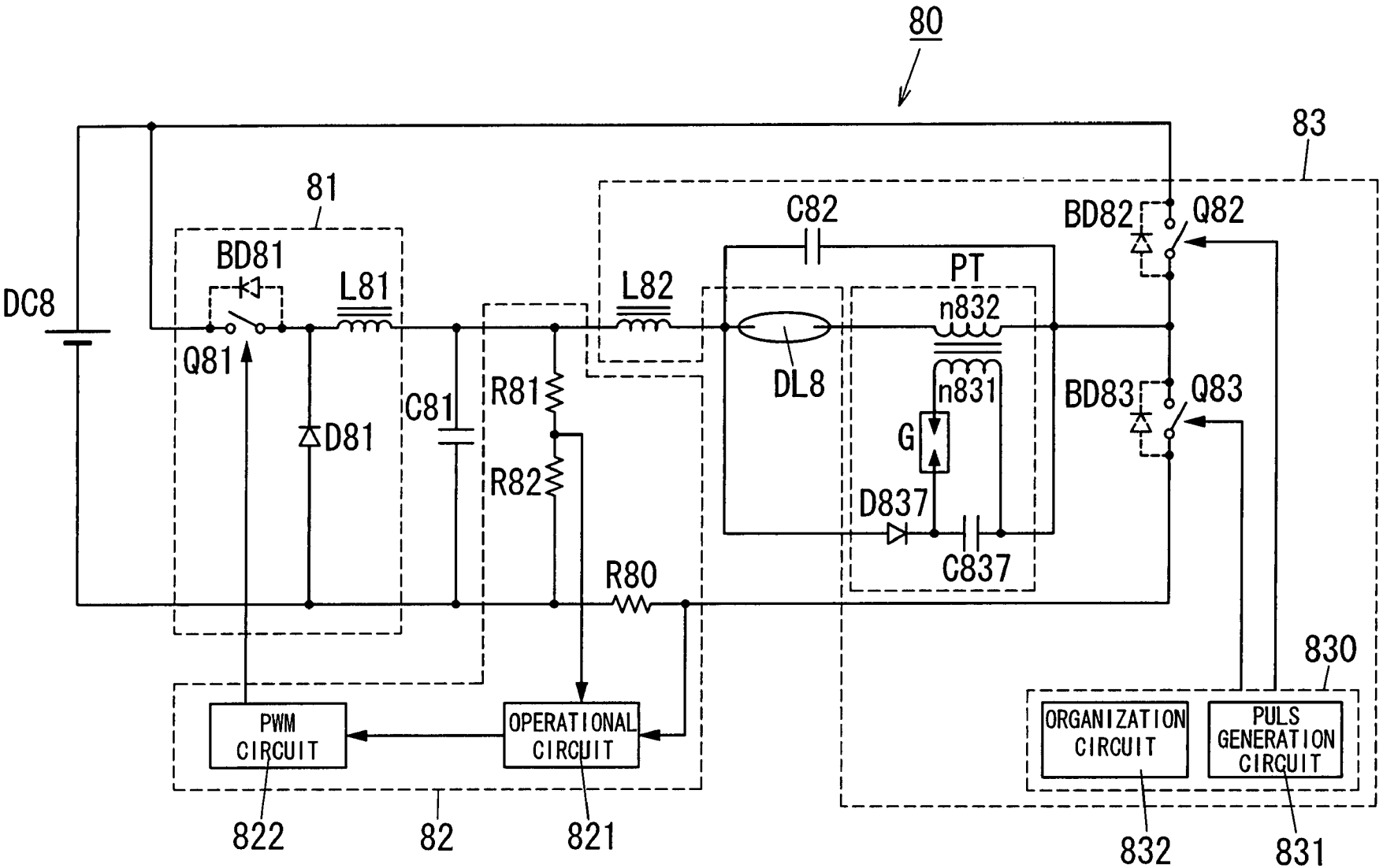
FIG. 20 is a circuit diagram of a discharge lamp ballast according to an eighth embodiment of the present invention.

FIG. 20 illustrates a discharge lamp ballast 80 for a discharge lamp DL8 (e.g., a DC discharge lamp such as a HID lamp or the like). This ballast 80 further comprises an igniter 837 in a starter 83 as compared with the first embodiment that is different only in that the starter13 consists of the inductor L12, the capacitor C12, the switching elements Q12 and Q13, and the starting controller 130.

In this eighth embodiment, the igniter 837 is constructed with a diode D837, a capacitor C837, a pulse transformer PT with a primary winding n831 and a secondary winding n832, and a gap G, and superposes pulse voltage responding to voltage applied across the primary winding n831 onto resonance voltage across a capacitor C82. An anode of the diode D837 is connected between an inductor L82 and the lamp DL8. The capacitor C837 is connected in series with the diode D837, while the series combination of the capacitor C837 and the diode D837 (hereinafter referred to as a "combination A") is connected in parallel with the capacitor C82. The winding n831 is connected in series with the gap G, while the series combination of the winding n831 and the gap G is connected in parallel with the capacitor C837. The winding n832 is connected in series with the lamp DL8, while the series combination of the winding n832 and the lamp DL8 is connected in parallel with each of the capacitor C82 and the combination A.

During a starting mode, resonance voltage (high frequency peak voltage) across the capacitor C82 is applied across the capacitor C837 via the diode D837, and therefore voltage across the capacitor C837 rises toward threshold voltage of the gap G. When the voltage across the capacitor C837 reaches the threshold voltage of the gap G, the capacitor C837 discharges against the primary winding n831 of the pulse transformer PT. As a result, pulse voltage is induced in the secondary winding n832 of the transformer PT. At this point, the pulse voltage generates electric field toward a negative terminal (second end) of the lamp DL8 from its positive terminal (first end). The pulse voltage is also generated in response to a turn ratio (n831:n832) of the transformer PT.

In case of any mode except the starting mode, resonance voltage across the capacitor C82 is not applied across the capacitor C837 via the diode D837, and therefore voltage across the capacitor C837 does not reach the threshold voltage of the gap G.

According to the eighth embodiment of the present invention, starting voltage is created by superposing the pulse voltage onto the resonance voltage across the capacitor C82, it is possible to reduce by the resonance voltage from the pulse voltage, so that noise from the starter 83 can be reduced. The igniter 837 of the eighth embodiment is also applicable to a starter in the above each embodiment.

Figure 21:
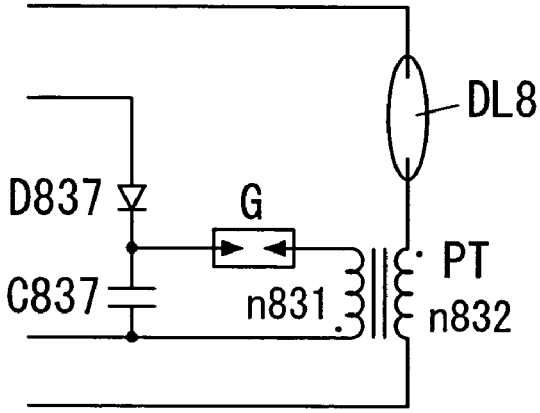
FIG. 21(*a*) illustrates another example of arrangement of a pulse transformer in the ballast of FIG. 20.
Figure 21:
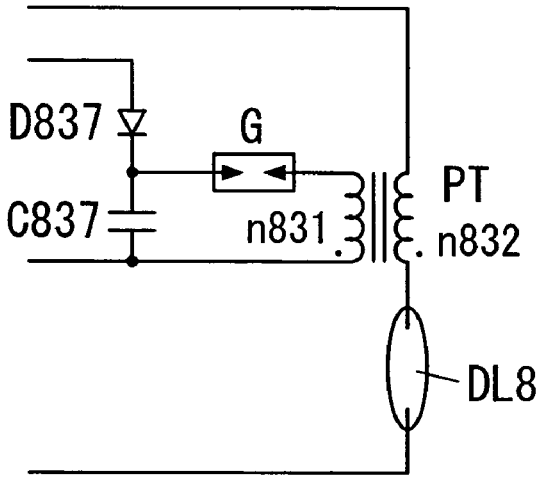
Figure 21:
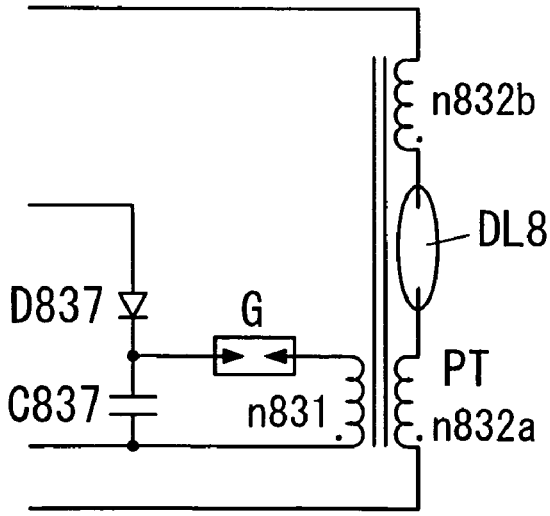

FIG. 21 illustrate various examples of arrangement of a pulse transformer PT. In arrangement of FIG. 21(*a*), the pulse voltage generates electric field toward the negative terminal of the lamp DL8 from its positive terminal in the starting mode. In arrangement of FIG. 21(*b*), the pulse voltage generates electric field toward the positive terminal of the lamp DL8 from its negative terminal in the starting mode. In arrangement of FIG. 21(*c*), the pulse transformer PT has secondary windings 832*a* and 832*b*, and in the starting mode, the pulse voltage generates electric field toward the negative terminal of the lamp DL8 from its positive terminal and electric field toward the positive terminal of the lamp DL8 from its negative terminal.

Therefore, the present invention achieves reduction of noise from the starting means (starter) and gives benefit of the noise reduction and high reliability in equipment such as a lighting system constructed with the ballast and the lamp, a projector constructed with the ballast and the lamp, or the like. Especially, in a liquid crystal projector, many minute electric circuits are located around a discharge lamp ballast, and therefore reducing noise from the starting means makes it possible to improve reliability.

Although the present invention has been described with reference to certain preferred embodiments, numerous modifications and variations can be made by those skilled in the art without departing from the true spirit and scope of this invention. For example, the embodiments include switching elements, such as power MOSFETs, but such elements may be replaced with bipolar transistors and diodes. In another example, the converter controller (12, 22, 32, 42, 52, 62 or 82) may turn the switching element (Q11, Q21, Q31, Q41, Q51, Q61, Q71 or Q81) on and off at a high frequency of a specific pulse width.

The invention claimed is:

1. A discharge lamp ballast, comprising:

a voltage step down converter connected to a DC power source with a positive terminal and a negative terminal;

a converter control means that controls the voltage step down converter;

a first capacitor that applies DC voltage across a discharge lamp through DC power from the voltage step down converter, said lamp having a first end and a second end; and a starting means that applies starting voltage across the discharge lamp in case of a starting mode, wherein said voltage step down converter is constructed with: a diode having a cathode and an anode, said anode being connected to the negative terminal of the DC power source and a negative voltage side of the first capacitor; a first switching element connected between the cathode of the diode and the positive terminal of the DC power source; and a first inductor connected between the cathode of the diode and a positive voltage side of the first capacitor, wherein said converter control means turns the first switching element on and off at a high frequency so as to supply DC power for steady operating to the discharge lamp via the first capacitor in case of a steady operating mode after the starting mode, wherein said starting means comprises:

a second inductor, one end of the second inductor being connected to the first end of the discharge lamp, the other end of the second inductor being directly connected to the positive voltage side of the first capacitor;

a second capacitor that is connected in parallel with the discharge lamp and forms a resonance circuit together with the second inductor;

a second switching element, one end of the second switching element being directly connected to the positive terminal of the DC power source, the other end of the second switching element being connected to the second end of the discharge lamp;

a third switching element connected between the second end of the discharge lamp and the negative voltage side of the first capacitor; and a starting control means that controls the second switching element and the third switching element, and wherein said starting control means is configured: to alternately turn the second switching element and the third switching element on and off so as to contribute resonance voltage of the resonance circuit for starting of the discharge lamp in case of the starting mode; and to operate so as to include an on period of the third switching element while keeping the second switching element turned off in case of the steady operating mode.

2. The discharge lamp ballast of claim 1, comprising a transformer with a primary winding and a secondary winding, wherein the primary winding is the second inductor, and the secondary winding is connected in series with the discharge lamp, while the series combination of the secondary winding and the discharge lamp is connected in parallel with the secondary capacitor.

3. The discharge lamp ballast of claim 1, wherein the second capacitor has capacitance smaller than that of the first capacitor.

4. The discharge lamp ballast of claim 1, wherein in case of the steady operating mode, the starting control means turns the third switching element on and off while synchronizing turning on and off of the third switching element with turning on and off of the first switching element.

5. The discharge lamp ballast of claim 1, wherein in case of the starting mode, the starting control means alternately turns the second switching element and the third switching element on and off approximately at a resonance frequency of the resonance circuit.

6. The discharge lamp ballast of claim 5, wherein in case of the starting mode, the starting control means alternately turns the second switching element and the third switching element on and off at a switching frequency of a continuous sweep frequency or a switching frequency of multistage frequency.

7. The discharge lamp ballast of claim 6, wherein the starting control means sweeps the switching frequency from a first frequency to a second frequency, while the means repeats the sweeping operation.

8. The discharge lamp ballast of claim 7, wherein the first frequency is higher than the second frequency.

9. The discharge lamp ballast of claim 5, wherein in case of a grow-arc transition mode between the starting mode and the steady operating mode, the starting control means alternately turns the second switching element and the third switching element on and off at a switching frequency lower than that in the starting mode.

10. The discharge lamp ballast of claim 1, wherein in case of the starting mode, the starting control means alternately turns the second switching element and the third switching element on and off approximately at a frequency $f0 \times 1/ODD$, where f0 is a resonance frequency of the resonance circuit and ODD is an odd number.

11. A lighting system, comprising the discharge lamp ballast and the discharge lamp of claim 1.

12. A projector, comprising the discharge lamp ballast and the discharge lamp of claim 1.

* * * * *